US005431512A

United States Patent [19]

Haney

[11] Patent Number: 5,431,512

[45] Date of Patent: Jul. 11, 1995

[54] FLEX TUBE COMPLIANT OFFSHORE STRUCTURE

[75] Inventor: James A. Haney, Bellaire, Tex.

[73] Assignee: McDermott International, Inc., New Orleans, La.

[21] Appl. No.: 174,851

[22] Filed: Dec. 28, 1993

[51] Int. Cl.[6] ..... E02B 17/00

[52] U.S. Cl. ..... 405/224; 405/195.1

[58] Field of Search ..... 405/195.1, 203, 204, 405/224, 227

[56] References Cited

U.S. PATENT DOCUMENTS

| | | | |
|---|---|---|---|
| 3,756,033 | 9/1973 | Kouka | 405/227 |
| 4,222,683 | 9/1980 | Schaloske et al. | 405/204 |
| 4,413,926 | 11/1983 | Ninet | 405/204 |
| 4,687,062 | 8/1987 | Beghetto et al. | 405/227 X |
| 4,854,779 | 8/1989 | Luyties | 405/224 X |
| 4,930,938 | 6/1990 | Rawstron et al. | 405/204 |
| 4,934,872 | 6/1990 | Klausen | 405/227 |
| 4,984,527 | 1/1991 | Falcimaigne | 405/195.1 X |

*Primary Examiner*—Randolph A. Reese
*Assistant Examiner*—John A. Ricci
*Attorney, Agent, or Firm*—Robert J. Edwards; D. Neil LaHaye

[57] ABSTRACT

A compliant offshore structure with flex tubes that are not driven into the sea bottom. A foundation template has bottles with skirt pile sleeves and a closed bottom socket. A tower and tower extension support the deck above the water line. The tower legs each enclose a flex tube such that there is an annulus between the leg and flex tube. The flex tube extends below the lower end of the leg so as to be received in the socket. The flex tubes are grouted in place in the sockets to connect the tower to the foundation template. Thickened wall portions may be provided on corresponding sections of the leg and flex tube to provide wear surfaces.

8 Claims, 4 Drawing Sheets

FLEX TUBE COMPLIANT OFFSHORE STRUCTURE

BACKGROUND OF THE INVENTION

1. Field of the Invention

The present invention is generally related to offshore platforms and particularly to offshore platforms where a vertical restoring couple is used to counter platform sway.

2. General Background

Most offshore oil and gas production is conducted from platforms secured to the ocean bottom. A key design constraint for such platforms is that there be no substantial dynamic amplification of the platform's response to waves. This is accomplished by designing the platform to have natural vibrational periods which do not fall within that portion of the range of wave periods representing waves of significant energy. The several modes of platform vibration which are generally of greatest concern in platform design are pivoting of the structure about the base(commonly termed "sway"), flexure(bending) in the vertical plane, and torsion about the vertical axis. For deep water applications, greater than about four hundred meters, the conventional rigid structure design becomes uneconomical. It then becomes necessary to use compliant platforms that have a sway period greater than the range of periods of ocean waves containing significant energy. A compliant platform uses its own inertia to increase the sway period, thereby reducing the dynamic amplification of the platforms response to waves, which in turn reduces the structural steel needed and higher cost associated with a given increase in water depth. Compliant platforms that use a guyed tower present the problems of high cost and interference with navigation and fishing in the area of the platform. The use of positive buoyancy by a tension leg platform presents problems of greater complexity and large and expensive hull structures.

U.S. Pat. No. 4,696,603 discloses a compliant offshore platform in which a number of flex piles that pass through guides are driven into the sea bottom adjacent each corner of the space frame structure of the offshore platform. The flex piles extend upward to a flex pile connector at a preselected location on the space frame structure where they are connected to the space frame structure. The flex piles act to maintain the platform sway within the desired vibration period range by being forced into tension and compression in conjunction with the sway of the platform.

Such a compliant platform presents certain difficulties and problems in transportation and installation. The space frame structure, commonly referred to as a tower, is very slender, i.e., it has a small cross sectional dimension at its base relative to its height. As such, it is susceptible to overturning during installation from forces generated by storms or by deep water currents. Until the requisite minimum number of piles are driven and attached to the tower, the tower is at greater risk of damage or loss from overturning than a conventional fixed platform would be. For these same reasons, water currents will easily tilt the tower from plumb prior to attachment of the flex piles to the tower. The flex piles are extremely long. The assembled length, including penetration into the sea bottom will exceed 1,500 feet in most cases. The longest piling that applicant is aware of that has been handled in one piece has been about 500 feet in total length. Thus, the flex piles will require specialized techniques offshore to assemble from sections short enough to be handled successfully. The tower must be built on shore lying on one side, skidded onto a launch barge, towed to the site, and launched into the water. Where the tower is sufficiently narrow, the corner legs of the tower can be situated above the launching ways of the launch barge. For this case, the tower will be supported on its side by the two lower corner legs, which rest in structural plate assemblages called cradles, which in turn rest on the launch ways of the launch barge. However, there is an array of guides for the flex piles about each corner leg at various positions along the legs. Therefore, the geometry of the array and the depth of the cradles must be chosen so that features on the tower, notably the flex pile guides, and features on the launch barge do not interfere. This problem results in deep cradles and, therefore represent a significant expense. Since the flex piles are immersed in sea water from the mud line upward, they must be protected from corrosion by sacrificial anodes. Because of the large surface area, the cost of the anodes required is significant. The connection of the flex piling to the tower at the top end of the flex piles and the framing members that attach the flex pile guides to the tower at various elevations along the piling represent a significant expense. Horizontal translation of the tower at the mud line is resisted by the flex piles acting in shear. In order to develop the shear in the flex piles, the bottom two levels of flex pile guides must develop a horizontal couple. This presents a wear problem when the force from the horizontal couple presses the outside of the flex pile against the inside of the flex pile guide while the flex pile is simultaneously moved axially relative to the flex pile guide by the compliant action of the platform. The resultant rubbing causes some wear from friction but results in an accelerated corrosion rate because the iron oxide and calcium carbonate coating being formed is constantly being rubbed off and exposes fresh elemental iron to the corrosion process. This can not readily be compensated for bey thickening of the flex pile since it is not known in advance if the design penetration of the flex pile into the sea bed will actually be achieved.

Article OTC 6351 by Deserts and Cortez discloses a similar compliant tower to that above with the difference being that two structural elements are used to perform the dual functions of the flex piling. A shallow foundation template is placed on the sea floor. Foundation piling is driven through sleeves in the foundation template, the foundation template is leveled, and then the annuli between the piling and sleeves are grouted to permanently connect the foundation template to the piling. Two flex tubes are preinstalled on opposite sides of each corner leg and extend a certain distance below the bottom of the tower. Sockets in the foundation template receive the flex tube extensions. This concept avoids the problems associated with assembling and driving the long flex piles offshore. Also, the problem of on-bottom stability of the slender tower during flex pile installation is eliminated by the preinstalled foundation template. Leveling the foundation template prior to grouting eliminates the problem of plumbing the slender towers. The wear problem is greatly reduced because the flex tube is preinstalled, not driven, so the location of the wearing surfaces on the flex tubes are known and thickened walls and hardened surfaces can be provided at these locations, as required.

SUMMARY OF THE INVENTION

The present invention addresses the above problems in a straightforward manner. What is provided is a compliant offshore structure that is formed from four major components that are fabricated on shore, transported to the offshore site, and installed in a stacked configuration. A foundation template is placed on the sea bottom and secured in place with pilings. The tower has legs that include flex tubes inside the tower legs. The flex tubes extend below the tower legs and are received in sockets in bottles at the corners of the foundation template. A tower extension, if necessary, is received in the top of the tower. The deck, or platform, is attached to the top of the tower extension in the normal manner. The flex tubes are received in the sockets such that there is a gap between the top of the socket and the bottom of the tower legs. The gap prevents the end of the tower legs from bearing against the ends of the sockets when the flex tubes are compressed by the sway of the platform. The present invention provides the following advantages over the known art. The total surface area exposed to sea water is reduced substantially, which results in a significant reduction in the cost of the sacrificial anode system. The projected area exposed to environmental forces from wave and current is reduced, which reduces the total overturning moment on the structure, thereby reducing the total load the flex tubes and piling must resist. This will result in cost savings for the piling and flex tubes. The cost of the guides for the flex tubes is essentially eliminated. The cost of the axial connection of the flex tubes to the tower is greatly reduced. Whenever the tower is narrow enough for the corner legs to be above the launching ways of the launch barge, the cradles will be eliminated which will result in a significant saving.

DETAILED DESCRIPTION OF THE PREFERRED EMBODIMENT

Figure 1:
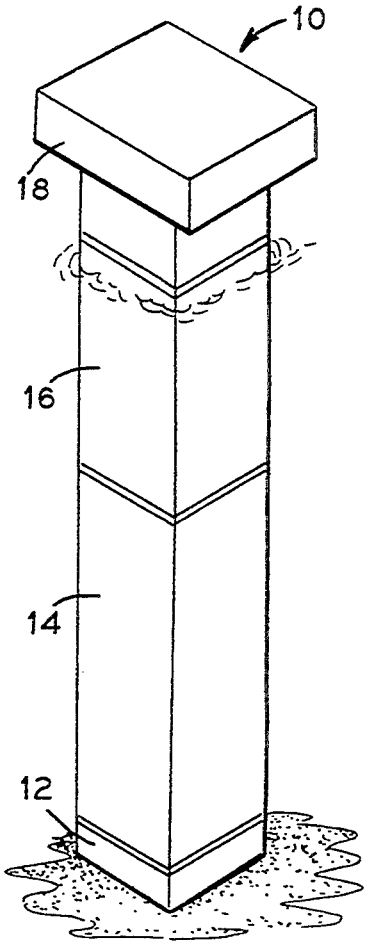
FIG. 1 is a schematic illustration of the invention.

Referring to the drawings, it is seen in the schematic of FIG. 1 that the invention is generally referred to by the numeral 10. Flex tube compliant offshore structure 10 is generally comprised of foundation template 12, tower 14, tower extension 16 when necessary, and deck 18.

Figure 3:
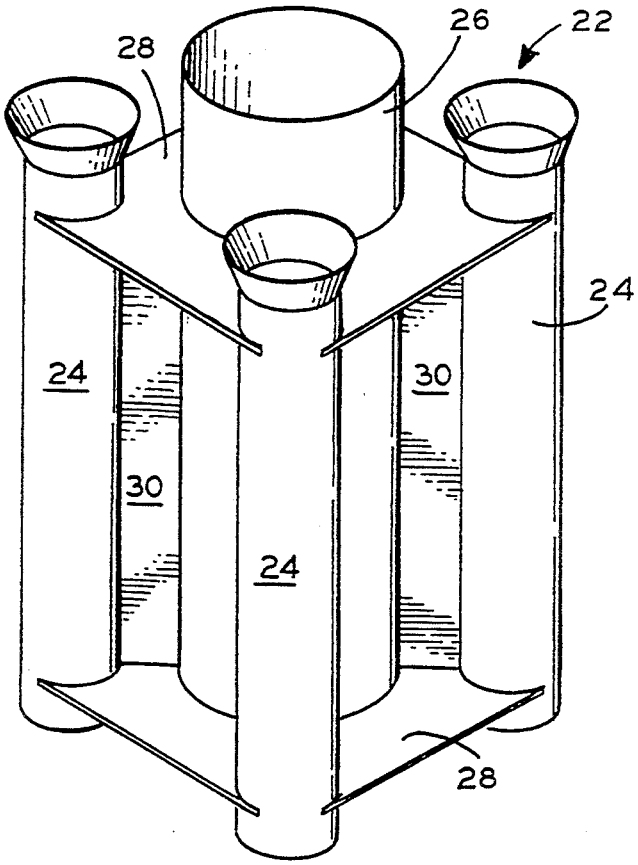
FIG. 3 is perspective view of one bottle of the foundation template.
Figure 2:
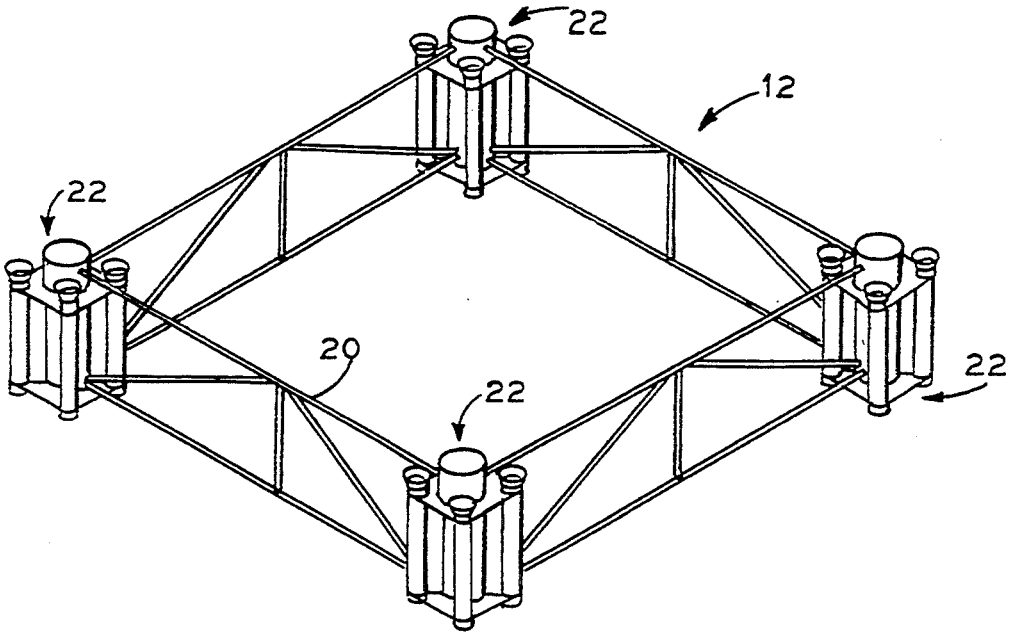
FIG. 2 is a perspective of the foundation template.

Foundation template 12, seen in FIG. 2, is designed to be anchored to the sea bottom and to support the tower by receiving the ends of the flex tubes from the tower. Framework 20 is provided with bottles 22, best seen in FIG. 3, that each have a plurality of sleeves 24 and a socket 26. In the offshore industry, "bottle" is a term commonly used to refer to a central leg with an array of pile sleeves attached to the central leg by yoke plates and shear plates. Each sleeve is formed from a cylindrical tube open at both ends and sized to receive skirt pilings that are driven through sleeves 24 into the sea bottom. The top of sleeves 24 may be tapered outwardly at the upper end for ease of insertion of the skirt pile. Socket 26 is formed from a tubular member that is closed at the bottom and sized to receive the lower end of the flex tube extending from the tower leg. Sleeves 24 and socket 26 are all connected together by yoke plates 28 and shear plates 30 to form a bottle.

Figure 5:
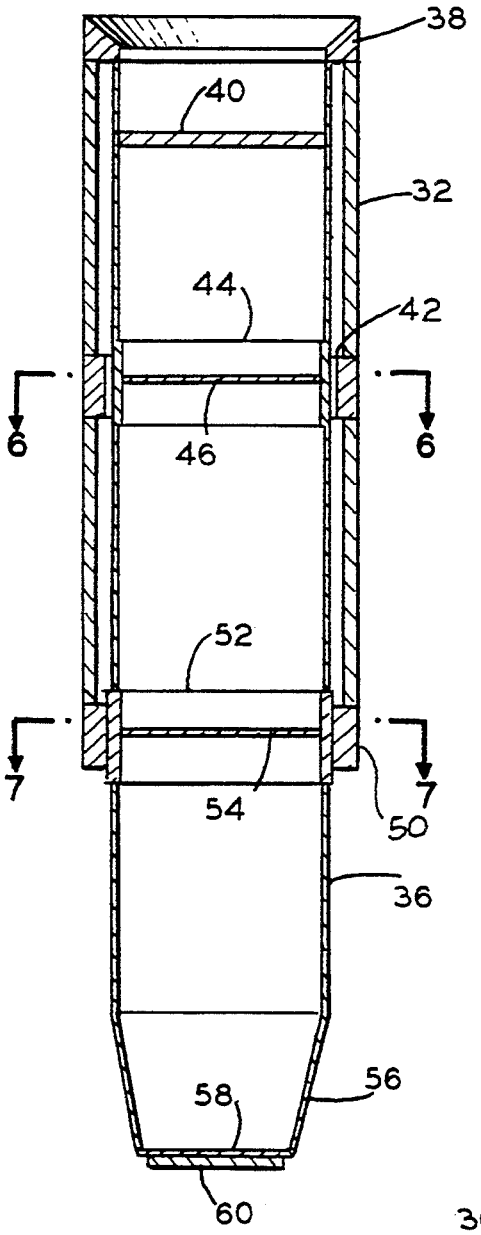
FIG. 5 is a view taken along lines 5—5 in FIG. 4.
Figure 4:
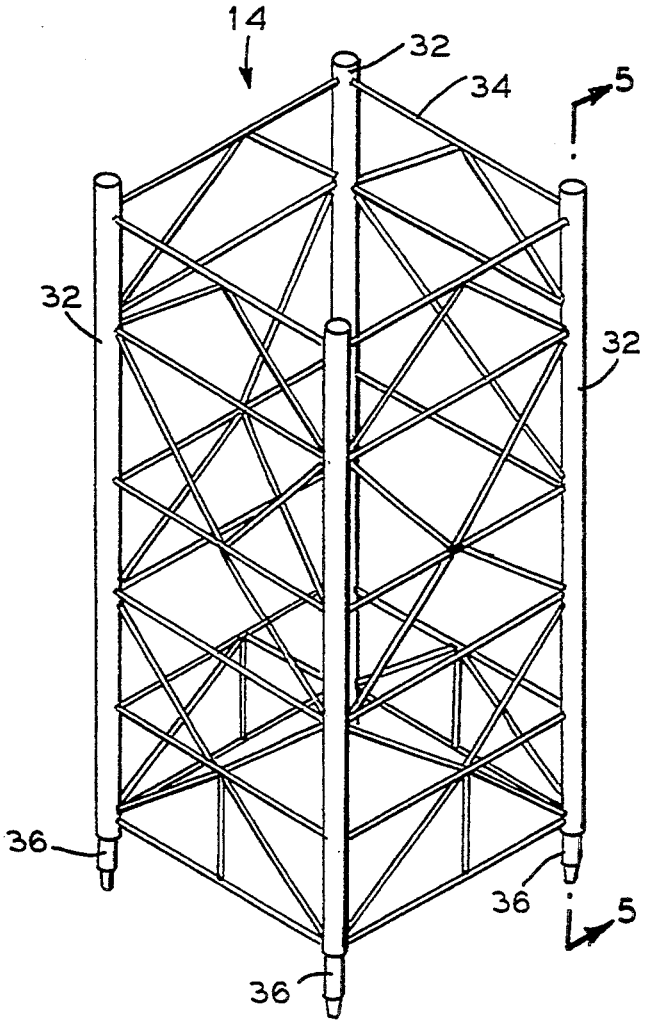
FIG. 4 is a perspective view of the tower.
Figure 6:
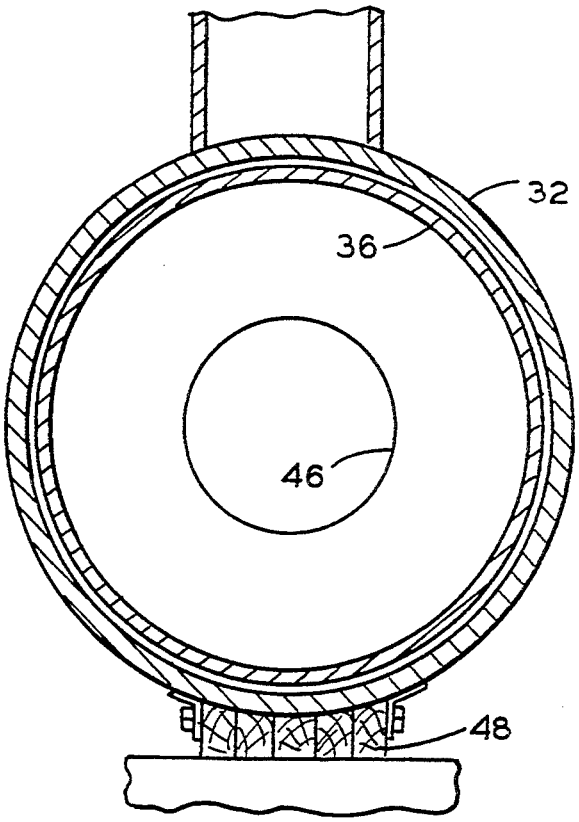
FIG. 6 is a cross sectional view taken along lines 6—6 in FIG. 5.
Figure 7:
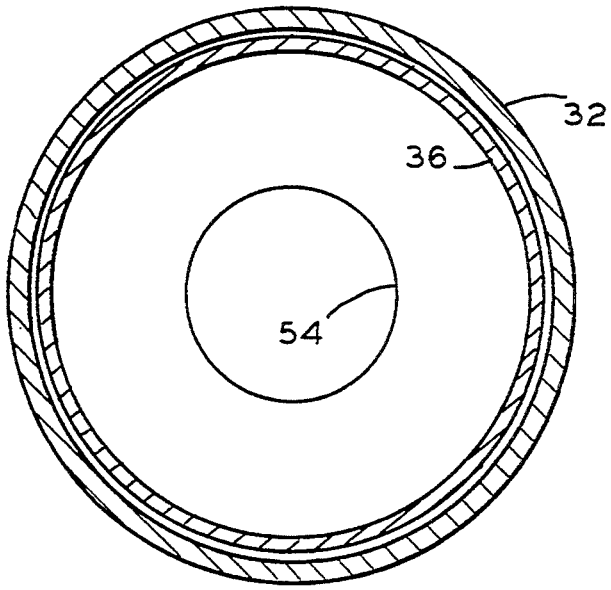
FIG. 7 is a cross sectional view taken along lines 7—7 in FIG. 5.

It can be seen in FIG. 4 that tower 14 is formed from legs held in a spaced apart relationship by framework 34. Flex tube 36 is enclosed in each leg 32 so as to define an annulus between the flex tube and leg and extend below the lower end of each leg 32. The longitudinal sectional view of FIG. 5 best illustrates the arrangement of a flex tube 36 within a leg 32. Each leg 32 and flex tube 36 are rigidly joined together at their upper ends by welding to a joining ring 38. Disk 40 is welded into flex tube 36 at a selected distance below the top of flex tube 36 to form the bottom of a socket in the upper portion of each leg 32. The socket is intended to receive the lower end of tower extension 16. Each leg 32 and flex tube 36 are adapted for safe load transfer while the tower rests on its side in the fabrication yard or on the launch barge. Each leg 32 is provided with a thickened wall section 42 on its inner circumference at a panel point of framework 34. This keeps the annulus between leg 32 and flex tube 36 small enough at the panel points so that leg 32 can deform elastically and pass the panel point load to flex tube 36. Flex tube 36 is provided with a thickened wall portion 44 on its inner circumference to prevent damage. A reinforcing ring plate 46 may also be provided at thickened wall portion 44 to help carry the panel point load through flex tube 36 and leg 32 and launch timbers 48 to the support surface in the fabrication yard or the launch barge as seen in FIG. 6. After installation at the offshore site, the movement of tower 14 in response to environmental forces can result in wear due to contact between legs 32 and flex tubes 36. This can be compensated for by providing thickened portions or a hardened surface as described above. Leg 32 is provided with thickened wall portion 50 on the inner circumference, flex tube 36 is provided with thickened wall portion 52, and reinforcing ring plate 54 may also be provided on the inside of flex tube 36. FIG. 7 illustrates a cross section of this portion of leg 32 and flex tube 36. The wear surfaces may be hardened and/or machined to obtain smooth wearing surfaces. The lower end of flex tube 36 may be provided with inwardly tapered section 56 to form a stabbing cone for ease of insertion into socket 26. Base plate 58 closes off the bottom of flex tube 36 to prevent water entry and provide an attachment point for leveling shim 60. One or more leveling shims 60 may be added to any of flex tubes 36 to aid in leveling tower 14 during final installation.

Figure 8:
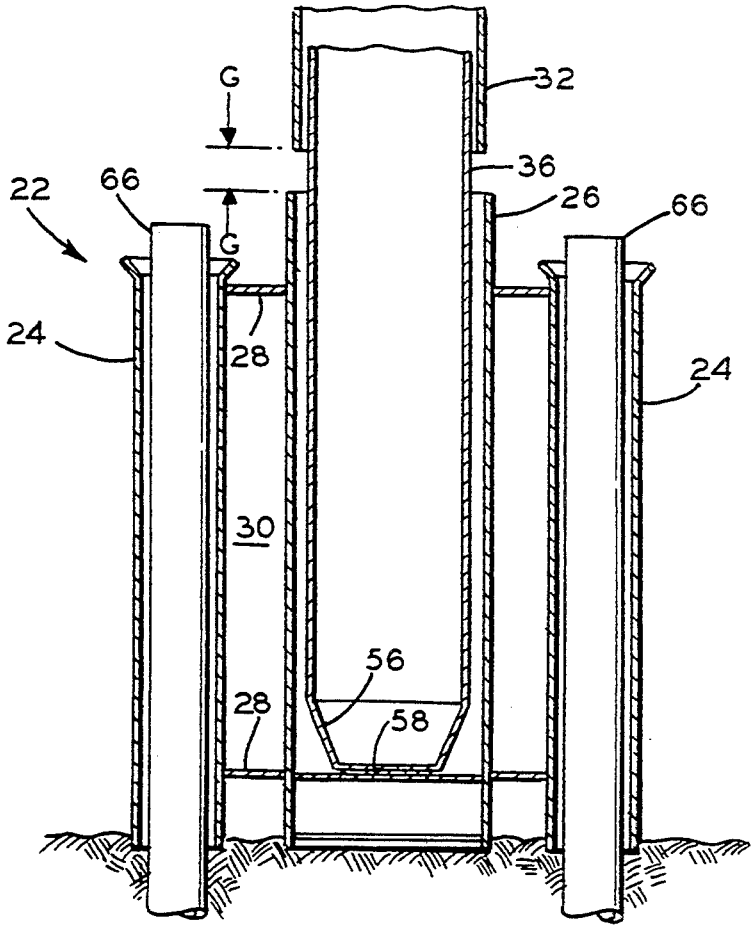
FIG. 8 is longitudinal sectional view through a bottle of the foundation template with the flex tube in the socket.
Figure 9:
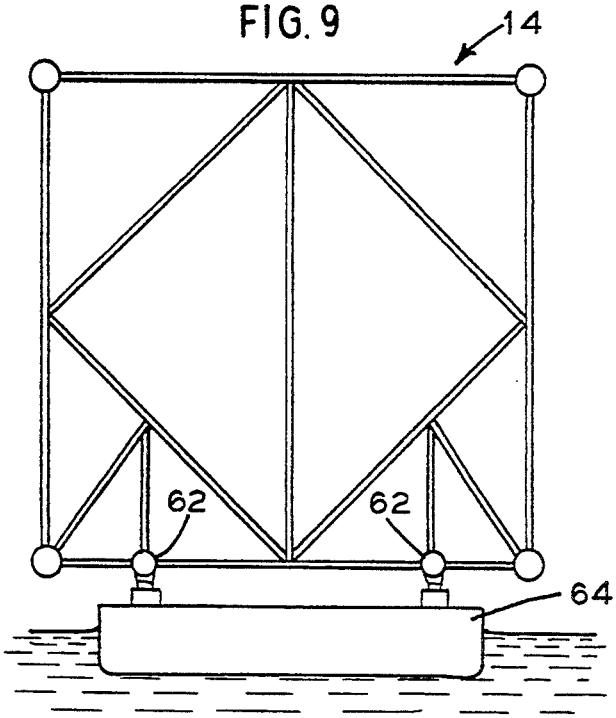
FIG. 9 is a sectional view that illustrates a tower on a launch barge for the case of a tower that is too wide for the corner legs to rest on the launch ways of the barge.

FIG. 8 illustrates flex tube 36 installed in socket 26. Socket 26, leg 32, and flex tube 36 are sized to insure that there will be a gap G between the lower end of each leg 32 and the upper end of socket 26 when each flex tube 36 is fully inserted into socket 26. This provides the necessary room for compression of flex tube 36 during sway of structure 10 to prevent interference between leg 32 and socket 26. Socket 26 may have a depth of eighty to ninety feet with gap G being a minimum of two to three feet.

The invention functions as follows during installation and use. The components may be transported to the offshore site in the normal fashion by flotation or being placed on a barge. In the event that the width of the tower exceeds the maximum possible spacing of the launch ways of the launch barge, support and launch legs 62 may be incorporated into the structure. Once at the site, foundation template 12 is positioned and one pile is driven to grade in each of at least three corners of foundation template 12. The foundation template is then made as level as possible by reacting against the driven skirt piles. The remaining skirt piles are driven. Skirt piles 66 are grouted in place in sleeves 24 to support the foundation template 12 and eventually structure 10. The levelness of foundation template 12 is then determined by direct measurement and shims 60 are added to the bottom of flex tubes 36 as necessary to obtain a level tower and deck upon final installation. Tower 14 is then launched from the barge 64 and flex tubes 36 are inserted into the proper sockets 26 to obtain a level structure. Flex tubes 36 are then grouted in sockets 26. Tower extension 16, if needed, is then installed on tower 14, and deck 18 is installed on tower extension 16. The attachment point of flex tubes 36 to legs 32 is dependent upon water depth. A general rule is that in relatively deep water the attachment point is approximately one-half the water depth. However, in shallow water the attachment point will be at a point that is a closer to the surface than half the water depth. As an example, the attachment point will be at approximately one thousand five hundred feet for a water depth of three thousand feet while the attachment point would be at approximately four hundred feet depth for a water depth of one thousand five hundred feet. The skirt pilings required for such an installation will normally have a seven to nine foot diameter and be driven five to six hundred feet into the sea bed. The flex tubes will normally have approximately a fourteen foot diameter and four inch thick wall. The size of the flex tubes is selected so that the tension and compression forces created by the sway of the structure are within the normal elasticity of the steel of the flex tubes.

What is claimed as invention is:

1. A compliant offshore structure for use in hydrocarbon drilling and producing operations, comprising:

a. a foundation template having skirt pile sleeves open at each end and a plurality of sockets closed at the bottom;

b. a tower with a plurality of hollow legs;

c. a flex tube received within each leg of said tower so as to define an annulus between said leg and flex tube, said flex tube being rigidly attached to said leg at the upper end of said flex tube and extending below the lower end of said leg whereby said flex tube is sized to be received in a socket in said foundation template; and d. a deck adapted to be attached to the top of said tower.

2. The structure of claim 1, wherein each of said flex tubes and the legs on said tower are provided with corresponding thickened wall sections at preselected locations.

3. The structure of claim 1, further comprising a tower extension between said tower and said deck.

4. The structure of claim 1, wherein a disk is rigidly attached inside each flex tube at a preselected distance below the top of said flex tube to define a socket in the upper end of said flex tube.

5. A compliant offshore structure for use in hydrocarbon drilling and producing operations, comprising:

a. a foundation template having skirt pile sleeves open at each end and a plurality of sockets closed at the bottom;

b. a tower with a plurality of hollow legs;

c. a flex tube received within each leg of said tower so as to define an annulus between said leg and flex tube, said flex tube being rigidly attached to said leg at the upper end of said flex tube and extending below the lower end of said leg whereby said flex tube is sized to be received in a socket in said foundation template;

d. a tower extension rigidly attached to said tower; and e. a deck adapted to be attached to the top of said tower extension.

6. The structure of claim 5, wherein a disk is rigidly attached inside each flex tube at a preselected distance below the top of said flex tube to define a socket in the upper end of said flex tube.

7. The structure of claim 5, wherein each of said flex tubes and the legs on said tower are provided with corresponding thickened wall sections at the lower end of the tower legs.

8. The structure of claim 5, wherein each of said flex tubes and the legs on said tower are provided with corresponding thickened wall sections at a panel point on said tower.

* * * * *